US005784085A

United States Patent [19]

Hosono et al.

[11] Patent Number: 5,784,085

[45] Date of Patent: Jul. 21, 1998

[54] INK JET PRINT HEAD WITH FLEXIBLE WALL MEMBER HAVING LOW AND HIGH ELASTICITY PORTIONS

[75] Inventors: Satoru Hosono; Toshihisa Saruta; Kazuo Koshino, all of Nagano, Japan

[73] Assignee: Seiko Epson Corporation, Tokyo, Japan

[21] Appl. No.: 533,934

[22] Filed: Sep. 26, 1995

[30] Foreign Application Priority Data

| | | | |
|---|---|---|---|
| Sep. 26, 1994 | [JP] | Japan | 6-229747 |
| Sep. 26, 1994 | [JP] | Japan | 6-229748 |
| Sep. 14, 1995 | [JP] | Japan | 7-262237 |

[51] Int. Cl.[6] ..... B41J 2/45

[52] U.S. Cl. ..... 347/70

[58] Field of Search ..... 347/68, 69, 70, 347/71, 72

[56] References Cited

U.S. PATENT DOCUMENTS

| | | | |
|---|---|---|---|
| 5,424,769 | 6/1995 | Sakai et al. | 347/70 |
| 5,539,982 | 7/1996 | Hosono et al. | 347/70 X |
| 5,560,090 | 10/1996 | Komakine et al. | 29/25.35 |
| 5,594,475 | 1/1997 | Komakine et al. | 347/9 |
| 5,617,127 | 4/1997 | Takeuchi et al. | 347/71 |

FOREIGN PATENT DOCUMENTS

| | | |
|---|---|---|
| 3-31141 | 5/1991 | Japan . |
| 4-1052 | 1/1992 | Japan . |

*Primary Examiner*—Edward Tso

*Attorney, Agent, or Firm*—Sughrue, Mion, Zinn, Macpeak & Seas, PLLC

[57] ABSTRACT

An ink jet print head including a flow path forming member having pressure generating chambers, ink supply paths, and reservoirs, a nozzle plate for covering one side of the flow path forming member, the nozzle plate having nozzle openings communicated with the pressure generating chambers, a flexible wall member for varying the volumes of the pressure generating chambers, the flexible wall member covering the other side of the flow path forming member, and piezoelectric vibrating elements for elastically deforming the flexible wall member, the piezoelectric vibrating element being in contact with the flexible wall member. The flexible wall member includes low elasticity portions and high elasticity portions for transmitting expanding and contracting motions of the piezoelectric vibrating elements to the pressure generating chambers, one end of each high elasticity portion being extended to a region of the ink supply path.

10 Claims, 6 Drawing Sheets

INK JET PRINT HEAD WITH FLEXIBLE WALL MEMBER HAVING LOW AND HIGH ELASTICITY PORTIONS

BACKGROUND OF THE INVENTION

1. Field of the Invention:

The present invention relates to an ink jet print head in use with an image forming apparatus of the type in which ink is jetted in the form of ink droplets from nozzle openings to an image recording medium, thereby forming an image of ink thereon.

2. Related Art

Examples of this type of the image forming apparatus are printers, copying machines, facsimile machines, and machines each having the functions of those machines. This type of the image forming apparatus has the following advantageous features. 1) It operates at low noise. 2) The cost to manufacture and the running cost are both low. 3) It is well adaptable for the color printing. With those features, the image forming apparatus rapidly increases its market share.

In this type of the ink jet print head, as disclosed in Published Unexamined Japanese Patent Application No. hei. 4-1052 (European Patent No. 443628), one of the sides of each pressure generating chamber is hermetically covered with a flexible wall member, which is fixedly supported at both ends. An electromechanical transducing element, or the piezoelectric vibrating element, is constructed such that piezoelectric vibrating members and electrode members are alternately layered in a state that a high elasticity portion formed on the flexible wall member intervenes therebetween. A displacement of the piezoelectric vibrating element is transmitted to the pressure generating chamber. The pressure generating chamber, when receiving the displacement, expands or compresses, so that ink contained in the chamber is shot forth in the form of ink droplet, through the nozzle opening.

In the ink jet print head using the electromechanical transducing element, a pressure is caused by making use of a mechanical oscillation of the member of large elastic modulus. Because of this, a low elasticity portion for converting a displacement of the electromechanical transducing element into a variation of the volume of the pressure generating chamber, is required for the ink jet print head.

To form the low elasticity portion, the pressure generating chamber is thinned at a portion thereof in the vicinity of the nozzle opening and the ink supply path. In the case of the pressure generating chamber having a relatively large low elasticity portion, the amount of ink droplet may be increased with respect to the quantity of displacement of the electromechanical transducing element. However, a response rate of the pressure generating chamber is reduced since the natural period of the pressure generating chamber is caused to be long by the compliance thereof by the low elasticity portion.

Recently, the market demanded higher print density. In a proposal to possibly satisfy the market demand, each pixel is printed by area modulation, viz., supposedly shooting forth a plural number of ink droplets, thereby increasing an effective print density.

In the ink jet print head of this type, the pressure generating chamber has the low elasticity portion of a relatively large area. When minute dots are formed in order to effect the area modulation, ink is improperly shot forth or no ink is shot forth because the compliance of the pressure generating chamber is excessively large with respect to the quantity of the displacement of the electromechanical transducing element.

SUMMARY OF THE INVENTION

For the above background reason, an object of the present invention is to provide an ink jet print head in which the amount of ink droplet by one shooting operation of ink is reduced, and the pressure generating chamber is driven at high speed, whereby printing by area modulation is realized.

To achieve the above object, there is provided an ink jet print head having a flow path forming member with pressure generating chambers, ink supply paths, and reservoirs, a nozzle plate for covering one side of the flow path forming member, the nozzle plate having nozzle openings communicating with pressure generating chambers, a flexible wall member for varying the volumes of the pressure generating chambers, the flexible wall member covering the other side of the flow path forming member, and piezoelectric vibrating elements for elastically deforming the flexible wall member, the piezoelectric vibrating elements being in contact with the flexible wall member. The ink jet print head is improved in that the flexible wall member includes low elasticity portions and high elasticity portions for transmitting expanding and compressing motions of the piezoelectric vibrating elements to the pressure generating chambers, one end of each high elasticity portion being extended to a region of the ink supply path.

With such a construction, the compliance of the pressure generating chamber, defined substantially by the low elasticity portion, is dispersed into the ink supply path and the reservoir. As a result, the pressure loss in the pressure generating chamber is reduced. Ink can be shot forth by a minute displacement of the electromechanical transducing element. As a result, a variation of the volume of the pressure generating chamber is reduced, and hence the amount of jetted ink is reduced. Further, reduction of the compliance of the pressure generating chamber leads to reduction of the ink jetting period, so that one pixel can be printed by a plural number of ink droplets for area tone.

BRIEF DESCRIPTION OF THE DRAWINGS

Other objects, features and advantages of the present invention will be apparent from the following detailed description in connection with the drawings, in which.

DETAILED DESCRIPTION OF THE PREFERRED EMBODIMENTS

The preferred embodiments of the present invention will be described with reference to the accompanying drawings.

Figure 1:
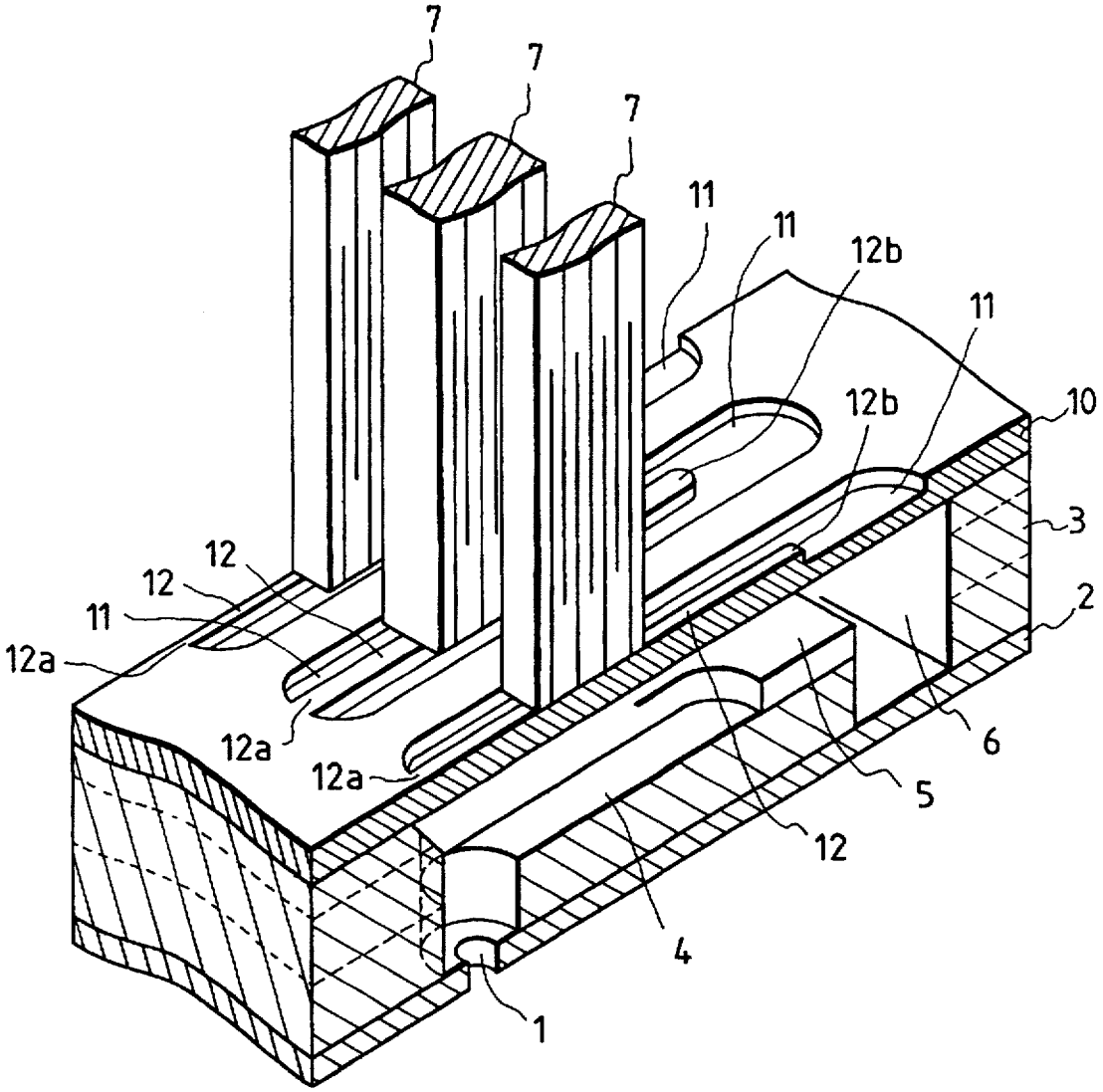
FIG. 1 is a perspective view showing an embodiment of an ink jet print head according to the present invention.
Figure 2A:
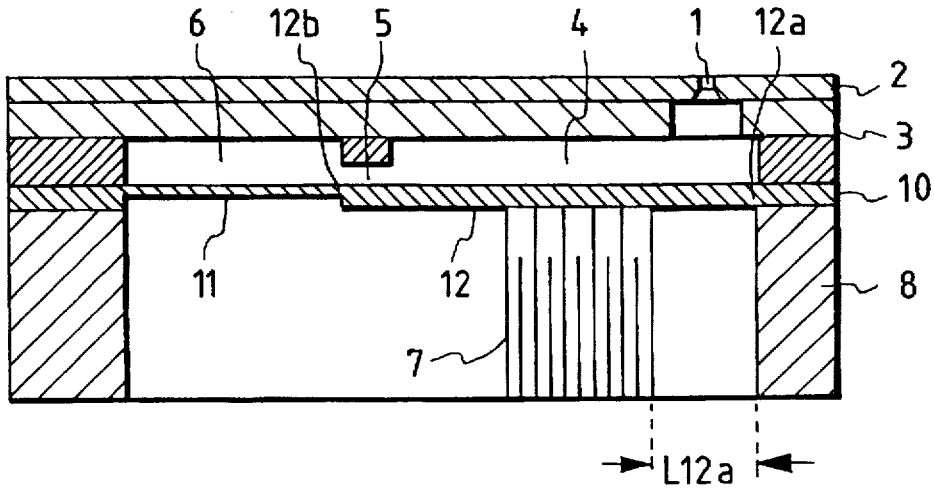
FIG. 2A is a cross sectional view showing a portion of the ink jet print head of FIG. 1 in the vicinity of the pressure generating chambers.
Figure 2B:
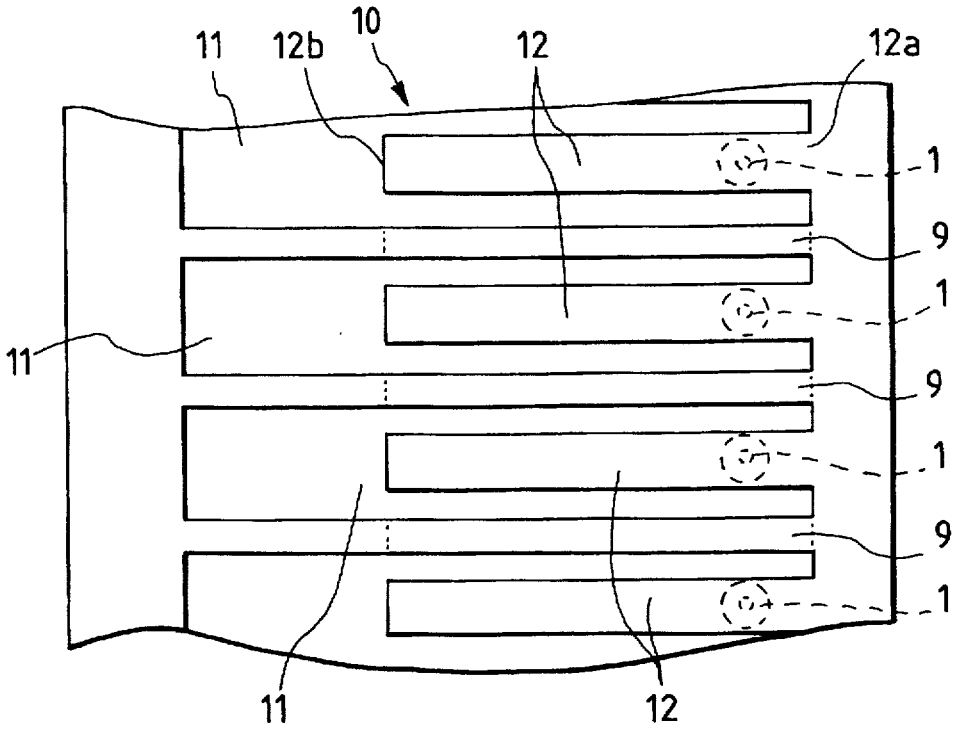
FIG. 2B is a plan view showing a flexible wall member used in the ink jet print head of FIG. 1.

FIGS. 1 and 2 show an embodiment of an ink jet print head according to the present invention. A nozzle forming member 2, a flow path forming member 3, and a flexible wall member 10 are coupled into an assembly. The assembly is fastened to a frame member 8 (FIG. 2). The nozzle forming member 2 includes a plural number of nozzle openings 1. The flow path forming member 3 includes pressure generating chambers 4 communicating with the nozzle openings 1, ink supply paths 5, and reservoirs 6. The flexible wall member 10 includes low elasticity portions 11 and high elasticity portions 12. Each of the low elasticity portions 11 of approximately 2 μm thick is formed by selectively patterning a stainless steel of 20 to 0.30 μm thick by etching process, for example.

The flexible wall member 10 is supported by the frame member 8 and the flow path forming member 3 at the outer ends of the pressure generating chambers 4 and at the outer ends of the reservoirs 6. Each of the high elasticity portions 12 has such a rigidity as to reliability transmit a displacement of the piezoelectric vibrating element 7 to the pressure generating chamber 4. One end 12*a* of the high elasticity portion 12, located closer to the nozzle opening 1, is extended to a location where it faces the flow path forming member 3, while the other end 12*b* thereof is extended up to a region of the ink supply path 5.

Each low.elasticity portion 11 extends from a part of portion of the wall member 10 facing the pressure generating chamber 4 associated therewith, i.e., from one side of the flexible wall member 10 not including the portion where the high elasticity portion 12 is formed (see FIG. 2B), to a portion facing the reservoir 6 beyond the ink supply paths 5. Reference numeral 9 designates partition walls which partition the pressure generating chambers 4.

The size of the nozzle opening 1, the thickness and the shape of the cross section of the nozzle forming member 2, and the dimensional accuracy of the flow path forming member 3, which includes the pressure generating chambers 4 and the ink supply paths 5, both being formed therein, greatly influence the ink jetting characteristics, such as the shooting velocity of an ink droplet, and the amount of jetted ink. Therefore, those members must be worked with high precision.

Precision press work, work by examiner laser, an electroforming process by nickel, and anisotropic etching process are preferable examples of working the nozzle forming member 2 and the flow path forming member 3.

The tip of each of the laminated type piezoelectric vibrating elements 7 is bonded to the high elasticity portion 12 by welding, for example.

Figure 3A:
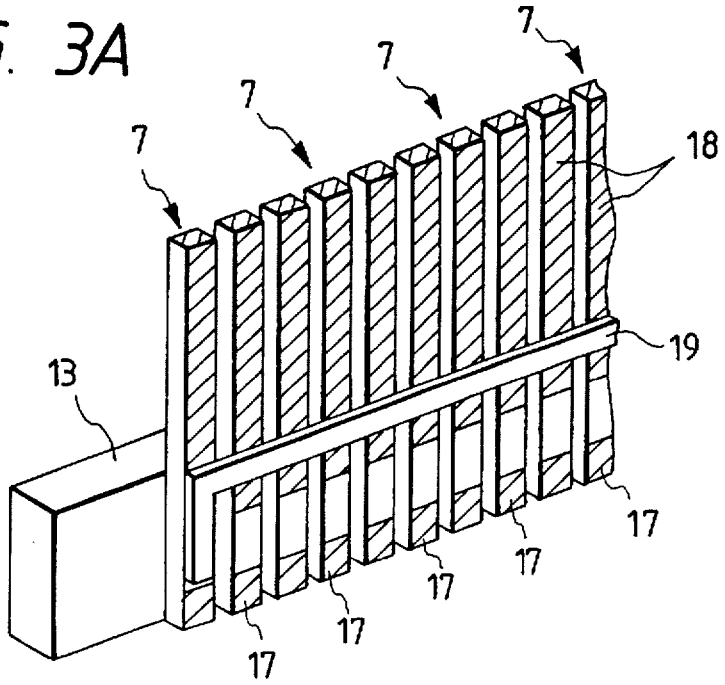
FIG. 3A is a perspective view showing an assembly of laminated piezoelectric vibrating elements, used in the ink jet print head.
Figure 3B:
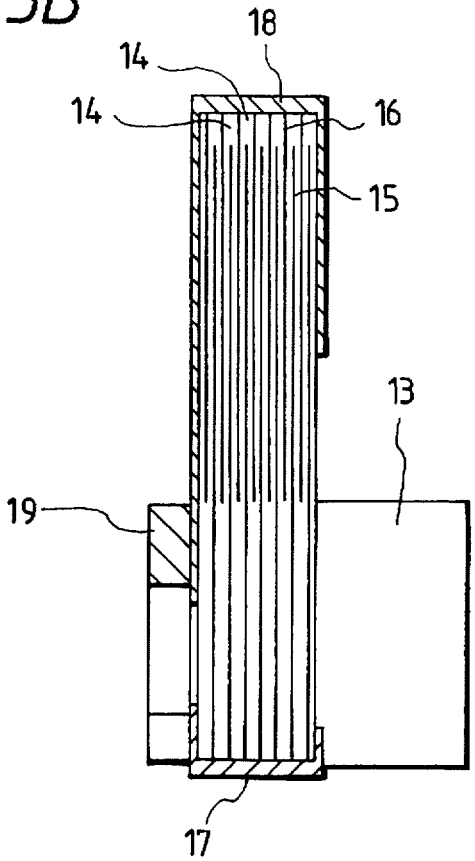
FIG. 3B is a sectional view showing the assembly of laminated piezoelectric vibrating elements shown in FIG. 3A.

In the construction of the laminated type piezoelectric vibrating element 7, as shown in FIGS. 3A and 3B, piezoelectric layers 14 and electrode layers 15 and 16 are laminated such that each piezoelectric layer 14 is sandwiched between its adjacent electrode layers. The piezoelectric layer 14, made of piezoelectric material, has the thickness of 20 to 30 μm. Each of the electrode layers 15 and 16, made of suitable electrode material, has the thickness of 2 to 5 μm. In the present embodiment, the piezoelectric vibrating element 7 vibrates in d31 mode; it displaces in the direction orthogonal to the laminating direction.

These piezoelectric vibrating elements 7 are fastened at one end to a base member 13, to form a piezoelectric vibrator unit, for ease of assembling of the resultant head. In the piezoelectric vibrator unit, the piezoelectric vibrating elements 7 are arrayed at pitches equal to those of the nozzle openings 1 in their array.

Electrodes 17 and 18 are mounted respectively on the bottom and the top of the piezoelectric vibrator unit. The electrodes 15 are connected to the electrodes 17 at the bottom of the piezoelectric vibrator unit, and the electrodes 17 are individual electrodes. The electrodes 16 are connected to the electrodes 18 at the top of the piezoelectric vibrator unit, and the electrodes 18 are connected together to the common electrode 19.

A distance L12*a* between the first end 12*a* of the high elasticity portion 12 and the piezoelectric vibrating element 7 is selected such that a reaction force of the flexible wall member 10 when it receives a displacement force from the piezoelectric vibrating element 7 is reduced to 1/100. As the distance L12*a* becomes shorter, the second end 12*b* of the high elasticity portion 12 is more greatly displaced. However, it is necessary to optimize this distance by taking account of the displacement efficiency and a reaction acting on the bonding face.

In the print head thus constructed, when a drive signal is applied to the piezoelectric vibrating element 7, the piezoelectric vibrating element 7 contracts. Then, the high elasticity portion 12, of which the first end 12*a* extends to a region of the nozzle opening 1 and the second end 12*b* extends to a region of the ink supply paths 5, is deformed by the compliance of the low elasticity portion 11 of the ink supply paths 5 and the reservoirs 6. As a result, the pressure generating chamber 4 is expanded.

After a predetermined period of time, the drive signal to the piezoelectric vibrating element 7 is stopped. Then, the piezoelectric vibrating element 7 is expanded, and the pressure generating chamber 4 is contracted. Also in this case, the high elasticity portion 12, of which the first end 12*a* extends to a region of the nozzle opening 1 and the second end 12*b* extends to a region of the ink supply path 5 and beyond the ink supply path 5, is deformed with the aid of the compliance of the low elasticity portion 11 of the ink supply path 5 and the reservoir 6. As a result, the pressure generating chamber 4 of a low compliance is contracted.

Since the area of the low elasticity portion 11, which faces the pressure generating chamber 4, is extremely small, the compliance of the pressure generating chamber 4 is small. The amount of ink droplet by one shooting operation of ink is small. It can satisfactorily follow up the expanding/compressing operation of the piezoelectric vibrating element 7. In other words, it is operable at a high speed.

Figure 4:
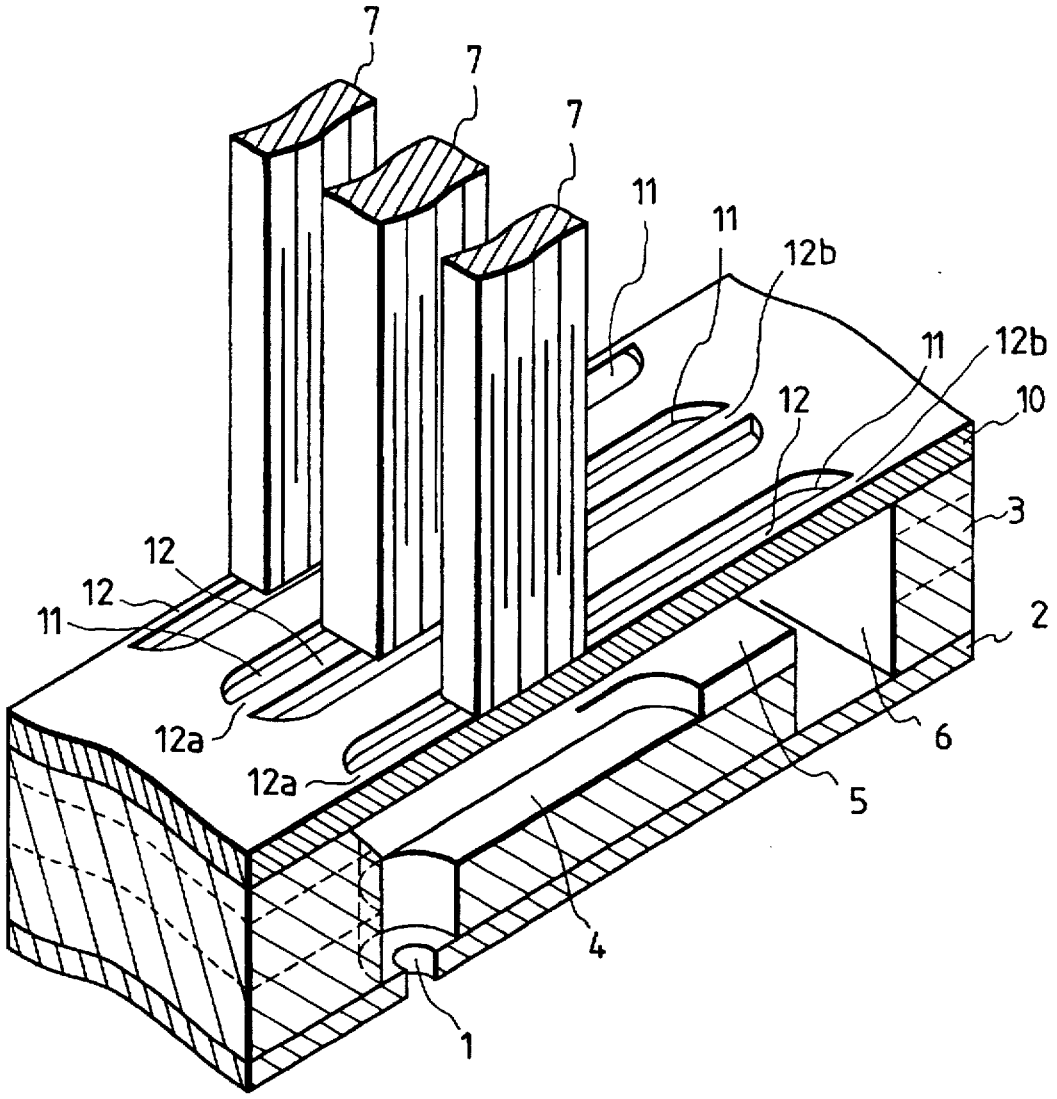
FIG. 4 is a perspective view showing another embodiment of an ink jet print head according to the present invention.

While in the present embodiment, the second end 12*b* of the high elasticity portion 12 is terminated near the ink supply path 5, both ends 12*a* and 12*b* of the high elasticity portion 12 may be extended to a region of the flow path forming member 3, as shown in FIG. 4.

This modification further reduces the compliance of the pressure generating chamber 4. The amount of ink droplet by one shooting operation of ink is reduced, and a high response of the pressure generating chamber 4 is realized.

Figure 5A:
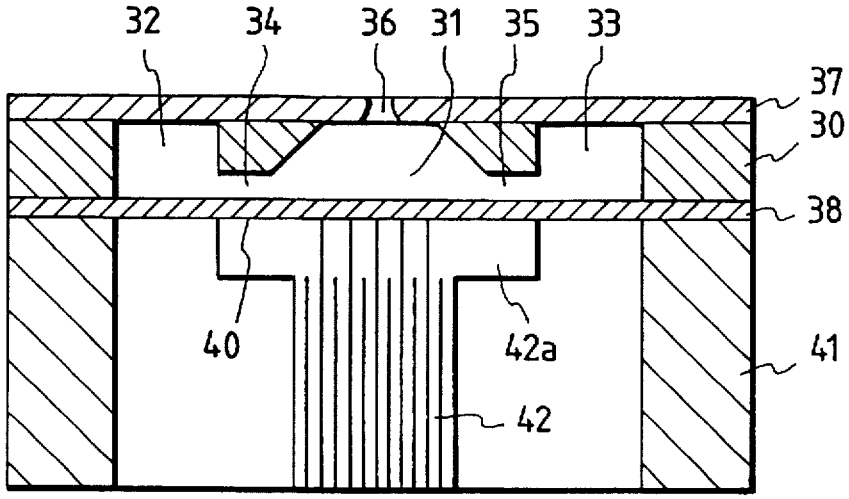
FIG. 5A is a cross sectional view showing a portion of the ink jet print head of FIG. 4 in the vicinity of the pressure generating chambers.

A second embodiment of the present invention will be described with reference to FIGS. 5A and 5B. In these figures, reference numeral 30 designates a flow path forming member. As shown in FIG. 5A, a space is defined by the flow path forming member 30, a nozzle plate 37 with a nozzle 36, and a flexible member 38. Within the space, a pressure generating chamber 31, two reservoirs 32 and 33, and ink supply paths 34 and 35 are formed. The reservoirs 32 and 33 are disposed on both sides of the pressure generating chamber 31. The pressure generating chamber 31 communicates with the reservoir 32 through the ink supply path 34. The pressure generating chamber 31 communicates with the reservoir 33 through the ink supply path 35.

Figure 5B:
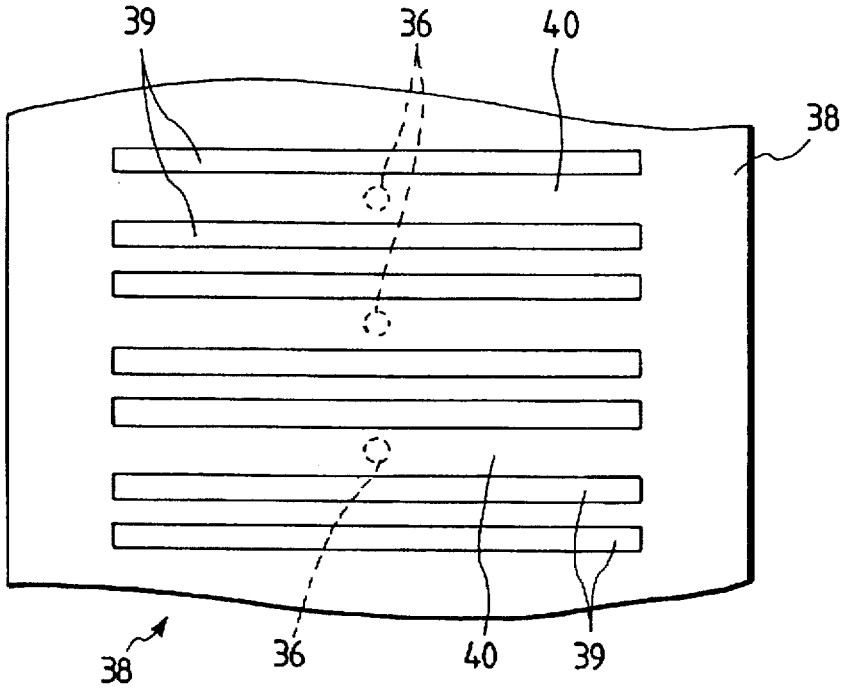
FIG. 5B is a plan view showing a flexible wall member used in the ink jet print head of FIG. 4.

As shown in FIG. 5B, the flexible member 38 includes high elasticity portions 40 and low elasticity portions 39. The high elasticity portion 40 is extended at both ends to reach a frame member 41. The high elasticity portion 40 is located between the paired low elasticity portions 39 when viewed in the width direction of the pressure generating chamber 31.

The high elasticity portion 40 receives a displacement of a piezoelectric vibrating element 42 through a pressure transmission member **42*a*, which is extended in the longitudinal direction of the pressure generating chamber 31, and varies the volume of the pressure generating chamber 31**.

Thus, one side of the high elasticity portion 40 is extended from one end of the pressure generating chamber 31 to the frame member 41 beyond the ink supply path 34 and the reservoir 32, while the other side thereof is extended from the other end of the pressure generating chamber 31 to the frame member 41 beyond the ink supply path 35 and the reservoir 33. The paired low elasticity portions 39 are located on both sides of the high elasticity portion 40. With this construction, the compliance of the pressure generating chamber 31 is defined by only the paired low elasticity portions 39 that are located on both sides of the pressure generating chamber 31. Because of this, it is extremely small. The ink amount reduction and the high response of the pressure generating chamber are both achieved.

Figure 6:
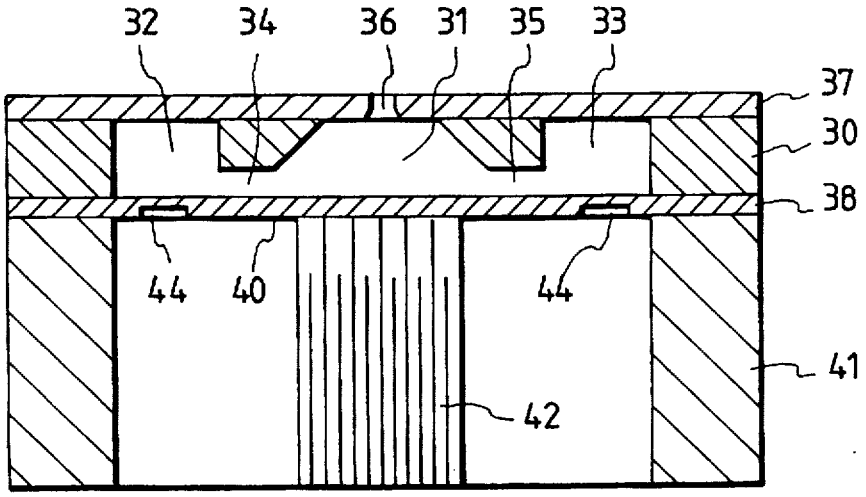
FIG. 6 is a cross sectional view showing a portion of another ink jet print head in the vicinity of the pressure generating chambers.

In the second embodiment, the piezoelectric vibrating element 42 is provided with the pressure transmission member **42*a*. With provision of the pressure transmission member 42*a*, a displacement force is uniformly distributed over the entire high elasticity portion 40. For this reason, the high elasticity portion 40 is constructed as a continuous member extended to reach the frame member 41. Further, according to the present invention, since both the ends of the pressure transmission member 42*a* are formed to extend up to the ink supply paths 34 and 35 as shown in FIG. 5A, the compliance of the pressure generating chamber 31 can be made lower. In a case where the pressure transmission member 42*a* is not used, low elasticity portions 44 are formed in the portions of the flexible member 38 which partially define the reservoirs 32 and 33 and are apart from the pressure generating chamber 31, as shown in FIG. 6. The low elasticity portions 44 assist the high elasticity portion 40 to vary the volume of the pressure generating chamber 31**.

Figure 7:
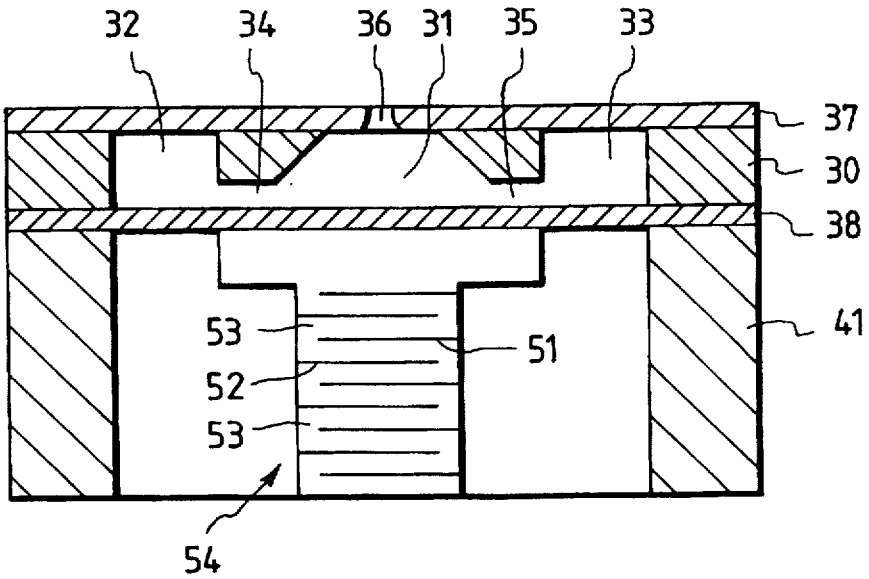
FIG. 7 is a cross sectional view showing a portion of yet another ink jet print head in the vicinity of the pressure generating chambers.

In the above-mentioned embodiments, a displacement d31 of the piezoelectric vibrating element in the direction orthogonal to the electric field is used. A piezoelectric vibrating element 54 vibrating in a d33 mode may also be used as shown in FIG. 7. The piezoelectric vibrating element 54 is constructed such that electrodes 51 and 52, and piezoelectric members 53 are alternately layered while being oriented in its desired displacing direction.

The flexible wall member for varying the volumes of the pressure generating chambers, which hermetically covers the second side of the flow path forming member, includes low elasticity portions and high elasticity portions for transmitting expanding and compressing motions of the piezoelectric vibrating elements to the pressure generating chambers, one end of each high elasticity portion being extended up to a region of the flow path forming member, which is located closer to the nozzle opening, and the other end thereof being extended at least to a region of the ink supply path. With such a construction, the compliance of the low elasticity portion, which occupies most of the compliance of the print head, is dispersed into the ink supply paths and the reservoirs. Accordingly, ink can be shot forth by a minute displacement of the electromechanical transducing element. The reduced amount of jetted ink and a high response of the print head are both realized.

In the print head, as disclosed in Published Unexamined Japanese Patent Application No. Hei. 4-1052, in which the pitch of the nozzle openings in the array of the nozzle openings is reduced in order to increase the print density of the print head, high precision is required for the shape and the position of the low elasticity portion. On the other hand, in the present invention, the low elasticity portion, which substantially determines the compliance of the print head, is located in the region of the reservoir, which has a larger area than the pressure generating chamber. This construction brings about many advantages. For example, formation of the low elasticity portion is easy. The shooting speed of the ink droplet is increased, the amount of the jetted ink is reduced, and a variation of the frequency of the head drive signal is minimized since those low elasticity portions do not take part in the jetting of ink.

The vibrating plate, which serves as a mere rigid plate in the regions of the ink supply path and the reservoir, gives rise to the compliance in those regions. Therefore, the necessary amount of jetting ink necessary for the print is secured without elongating the pressure generating chamber. The high density array of the nozzle openings is realized without enlarging the print head.

With the compliance of the low elasticity portion located in the region of the reservoir, the pressure of ink returned from the pressure generating chamber to the reservoir is absorbed, so that no cross talk takes place between the adjacent pressure generating chambers.

While some specific embodiments of the present invention have been described, it should be understood that the invention may variously be modified, altered and changed within the scope of the appended claims.

What is claimed is:

1. An ink jet print head comprising:

a flow path forming member having pressure generating chambers, ink supply paths and reservoirs, a nozzle plate for covering one side of said flow path forming member, said nozzle plate having nozzle openings communicating with said pressure generating chambers, a flexible wall member for varying the volumes of said pressure generating chambers, said flexible wall member covering hermetically the other side of said flow path forming member, said flexible wall member comprising low elasticity portions and high elasticity portions, one end of each high elasticity portion extending to a region of said ink supply path, and piezoelectric vibrating elements for elastically deforming said flexible wall member, said piezoelectric vibrating elements being in contact with said flexible wall member, expanding—and contracting-motions of said piezoelectric vibrating elements being transmitted to said pressure generating chambers by said low elasticity portions and said high elasticity portions of said flexible wall member.

2. An ink jet print head comprising:

a flow path forming member having pressure generating chambers, ink supply paths and reservoirs, a nozzle plate for covering one side of said flow path forming member, said nozzle plate having nozzle openings communicating with said pressure generating chambers, a flexible wall member for varying the volumes of said pressure generating chambers, said flexible wall member covering hermetically the other side of said flow path forming member, said flexible wall member comprising:

low elasticity portions each defining a compliance of said pressure generating chamber associated therewith, and high elasticity portions, one end of each high elasticity portion extending to a region of said flow path forming member adjacent said nozzle opening, and the other end thereof extending at least as far as a region of said ink supply path; and piezoelectric vibrating elements for elastically deforming said flexible wall member, said piezoelectric vibrating elements being in contact with said flexible wall member, expanding—and contracting-motions of said piezoelectric vibrating elements being transmitted to said pressure generating chambers by said high elasticity portions of said flexible wall member.

3. The ink jet print head according to claim 1, wherein each of said low elasticity portions extends to a region of said reservoir associated therewith.

4. The ink jet print head according to claim 2, wherein each of said low elasticity portions extends to a region of said reservoir associated therewith.

5. The ink jet print head according to claim 1, wherein another end of each high elasticity portion is supported by said flow path forming member, and said low elasticity portion is shaped so as to surround each high elasticity portion.

6. The ink jet print head according to claim 1, wherein said one end and an opposite end of each high elasticity portion are supported by said flow path forming member, and said low elasticity portions are located on both sides of each high elasticity portion when viewed in a width direction of each pressure generating chamber.

7. The ink jet print head according to claim 1, wherein said flow path forming member, said nozzle plate, and said flexible wall member are coupled into a single assembly, and said assembly is fastened to a frame member.

8. The ink jet print head according to claim 2, wherein said flow path forming member, said nozzle plate, and said flexible wall member are coupled into a single assembly, and said assembly is fastened to a frame member.

9. An ink jet print head as recited in claim 1, wherein said flexible wall member is a plate shaped member having different thicknesses.

10. An ink jet print head as recited in claim 2, wherein said flexible wall member is a plate shaped member having different thicknesses.

* * * * *